United States Patent [19]

Trausch

[11] Patent Number: 4,626,323

[45] Date of Patent: Dec. 2, 1986

[54] METHOD FOR THE MANUFACTURE OF A PRINTING ELEMENT FOR AN INK DROPLET PRINTING UNIT

[75] Inventor: Guenter E. Trausch, Munich, Fed. Rep. of Germany

[73] Assignee: Siemens Aktiengesellschaft, Berlin and Munich, Fed. Rep. of Germany

[21] Appl. No.: 839,548

[22] Filed: Mar. 14, 1986

[30] Foreign Application Priority Data

Apr. 10, 1985 [DE] Fed. Rep. of Germany ..... 3512837

[51] Int. Cl.[4] ..... C25D 5/02

[52] U.S. Cl. ..... 204/15; 204/24; 204/38.4

[58] Field of Search ..... 204/15, 24, 38.4

[56] References Cited

U.S. PATENT DOCUMENTS 4,374,707 2/1983 Pollack ..... 204/24
4,438,191 3/1984 Cloutier ..... 204/15
4,528,577 7/1985 Cloutier ..... 204/15

*Primary Examiner*—T. M. Tufariello
*Attorney, Agent, or Firm*—Hill, Van Santen, Steadman & Simpson

[57] ABSTRACT

A method of producing a printing element or writing head having a common ink chamber formed in a surface of the substrate which chamber has a pair of channels separated by a ridge and is covered by a comb and conductor loop arrangement having middle portions with the ink nozzle characterized by applying a plurality of different layers on the substrate, creating an electroplating mask on the last-applied layer, electroplating to produce the structure for the comb and conductor loops, then forming an etching mask by removing portions of the plating mask and the layers of material underneath those portions in the area of the channel, removing the material of the substrate to form the channel and then subsequently removing layers to loosen the middle portions of each of the conductor loops from the ridge.

13 Claims, 5 Drawing Figures

METHOD FOR THE MANUFACTURE OF A PRINTING ELEMENT FOR AN INK DROPLET PRINTING UNIT

BACKGROUND OF THE INVENTION

The present invention is directed to a method for the manufacture of a galvanically formed metal comb arrangement composed of individual drive elements for an ejection of ink droplets in an ink printer which method utilizes individual and discrete steps.

Ink printing devices are known and an example is disclosed in U.S. Pat. No. 4,544,933 whose disclosure is incorporated by reference thereto. In U.S. patent application Ser. No. 815,922, which was filed Jan. 3, 1986, and was based on German application No. 3,500,985, a different construction for an ink printing device was disclosed. In the device of the application, a common chamber with two portions is formed in a glass substrate with a ridge extending along the length of the chambers and between the portions; and a plurality of conductor loops or drive elements extend across the common ink chamber and have a middle portion overlying the ridge. Instead of providing a nozzle plate having each of the nozzles, the middle portion or part of each of the conductor loops has an aperture or breach which forms the discharge nozzle associated with that loop.

To eject an individual droplet, the movable middle part executes a movement opposite the ejection direction for the ink droplet. If desired, a cavity may be provided for each of the openings, which cavity may be formed as an enlarged opening on a surface of the middle portion facing the ridge of the ink chamber. The application discloses conductor loops which have either a straight line configuration, which is at an angle to the ridge in the ink chambers and may be either a single row or a multirow nozzle arrangement, or a V-shaped configuration.

SUMMARY OF THE INVENTION

The object of the present invention is to provide a method for manufacturing a printer element having a substrate with a common ink chamber and the conductor loops overlying the ink chamber and having the openings forming the discharge nozzles.

To accomplish this goal, the present invention is directed to a method of forming a printing element or part for an ink printing unit which part has a glass substrate which on one surface has a common ink chamber with two channels separated by a ridge extending along the length of the chamber and has conductor loops extending across the chamber, which loops have a middle portion provided with an ink orifice overlying the ridge. The method comprises providing a glass substrate with a glass surface; forming a strip of a first double layer on a part of the glass surface overlying the area in which the ridge is to be formed by depositing a first metal layer on a surface of the substrate, depositing a second metal layer on the first metal layer to form the first double layer and shaping the first double layer into the strip by removing the double layer except in the area of the ridge; then depositing a second double layer on the strip and the substrate surface by depositing a third layer of metal on the strip and the exposed portions of the glass substrate, and depositing a fourth metal layer on the third layer with the steps of depositing the first, second, third and fourth layers being either by vapor-depositing or sputtering; providing an electroplating mask structure on an exposed metal surface of the last-applied layer by photolithographically forming a positive dry resist structure on the metal surface of the last-applied metal layer, said mask structure defining a position for each nozzle and leaving portions of the metal surface exposed in a pattern corresponding to the comb having the conductor loops; exposing to UV light portions of the resist structure which overlie a region for each of the two ink channels which are to be subsequently formed; electrodepositing a comb having the conductor loops separated by gaps and the leads between the portions of the mask structure; removing the UV-exposed portions of the resist structure by resist development to form spaces between adjacent conductor loops in said region; form an etching mask for etching the channel by etching the exposed metal layers beneath the spaces and beneath the adjacent conductor loops to expose portions of the glass substrate; removing material from the surface of the glass substrate by utilizing the etching mask and an etching process with ultrasonic to form two ink channels separated by said ridge; subsequently removing the remaining resist structure; and then loosening a middle portion of each of the conductor loops from the glass ridge extending between the ink channels by selectively etching the second layer away and then etching away the first and third metal layers positioned between the ridge and the middle portion of each of the conductor loops so that each middle portion may move relative to the loop during the ejection of an ink droplet through the nozzle opening.

The first double layer of metal is preferably composed, for example, of a 0.1 μm thick layer of titanium as the first layer and a 1.0 μm thick second layer of aluminum. Preferably, the third layer is a titanium layer with a thickness of 0.1 μm and the fourth layer is a copper layer of 0.5 μm thick. The comb and the leads which form the conductor loops is preferably a layer of nickel having a thickness of 50 μm. The ink channels of the chamber are preferably etched to a depth of approximately 200 μm in the surface of the glass substrate.

It is possible with the method of the present invention to realize the structure arrangement such as disclosed in the above-mentioned U.S. patent application in a simple way and with a compact structure such that the electrical balancing of the individual conductor loops for leveling the oscillatory behavior becomes superfluous. Moreover, the comb system can be produced in multiple arrangements on a glass carrier.

Other objects and advantages of the present invention will become readily apparent from the description of the preferred embodiments, the drawings and the claims.

DESCRIPTION OF THE PREFERRED EMBODIMENTS

Figure 3:
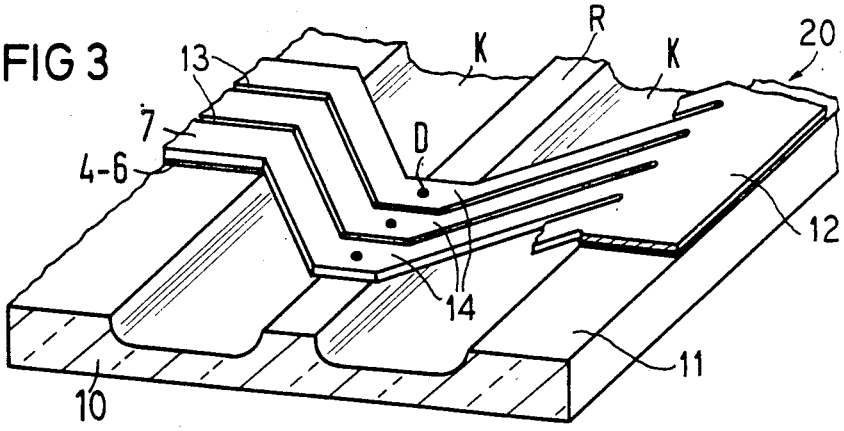
FIG. 3 is a perspective view with portions broken away for purposes of illustration of the completed write head or printing element.

The principles of the present invention are particularly useful in forming a writing head or printing element which is generally indicated at 20 in FIG. 3 and is used in an ink printer. The element 20 has a glass carrier 10 with one surface 11 which has an ink chamber with two channels K separated by a ridge R formed therein. A comb having a plurality of drive elements or conductor loops 7 which are separated by gaps 13 but connected at one side 12 of the comb is secured on the surface 11. Each of the drive elements 7 has a center portion or part 14 which overlies the ridge R and is provided with a nozzle D.

In operation, movement of each of the drive elements 7 off and towards the ridge R will cause a drop of ink to be expelled through the nozzle D. This movement is caused by assembling the unit 20 with a magnet arrangement such as discussed in the above-mentioned U.S. patent application and U.S. patent. When a current is connected to one of the selected drive elements 7, the element will move due to the particular magnetic field in a known manner and cause a drop of ink to be expelled from the nozzle D.

To produce the element 20, a glass substrate 1 is provided. A first layer 2 is deposited on the surface of the carrier 1 and a second layer 3 is deposited on top of the first layer 2 to form a first double layer. The next step is to structure the double layer by removing portions so that only a strip 17 remains on the surface of the carrier 1, which strip 17 covers the ridge R which is to be formed. After structuring the layers 2 and 3, a third layer 4 is deposited on the exposed surfaces of the substrate 1 and the layer 3 and then a fourth layer 5 is applied onto the layer 4 to form a second double layer. The layers 2, 3, 4 and 5 can be deposited by either sputtering or by vapor-deposition. If desired, an additional or fifth layer 6 can be electrodeposited or plated onto the layer 5. This layer 6 is often utilized to improve the adhesion of the subsequently formed drive elements to the glass and in order to reinforce the coverage in the non-glass regions which are subsequently etched.

Figure 1:
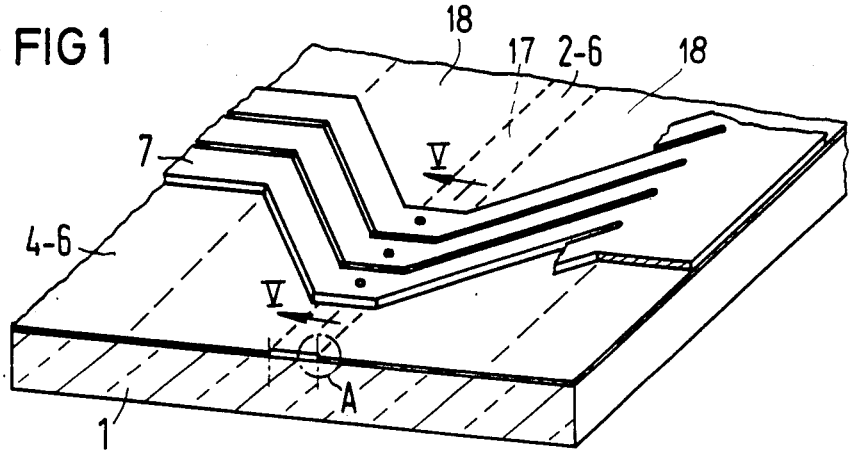
FIG. 1 is a perspective view with portions broken away for purposes of illustration of an intermediate stage of producing the printing element in accordance with the present invention.
Figure 2:
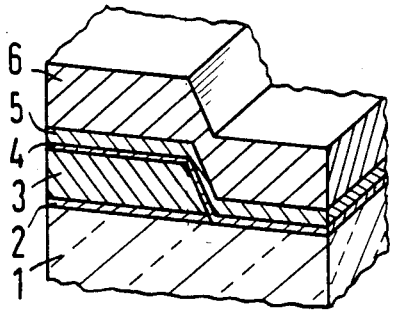
FIG. 2 is an enlarged cross-sectional view taken from the area of the circle A in FIG. 1.
Figure 5:
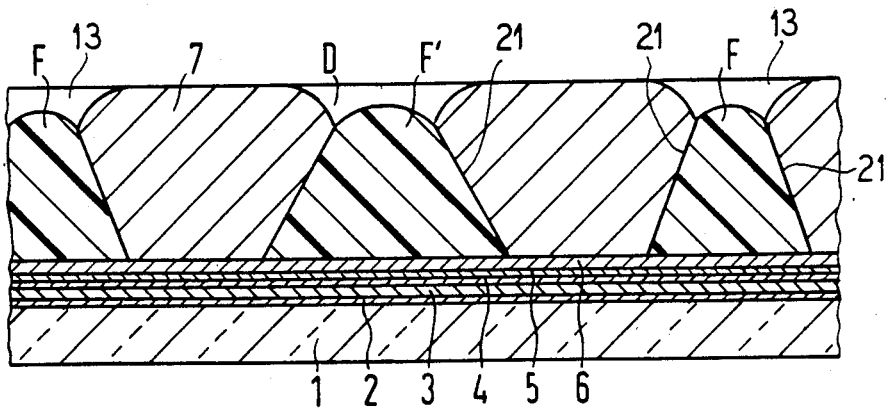
FIG. 5 is a cross-sectional view taken approximately along line V—V of FIG. 1.

Assuming as illustrated the fifth layer 6 has been applied, then an electroplating mask F is provided on the fifth layer by photolithographically forming a positive dry resist structure on the last-applied layer which is the layer 6 and this mask F will have portions corresponding to the gaps 13 between the drive element 7 and also portions F' corresponding to the nozzles D as illustrated in FIG. 5. Subsequent to applying the resist structure, portions of it are UV-exposed in the areas of region 18 (FIG. 1) overlying the position for the two ink channels K.

Subsequent to the exposing of the resist structure, a metal layer is electrodeposited or electroplated to form the comb with the drive elements or conductor loops 7 which are separated by the gaps 13. After electrodepositing the metal for the comb and drive elements 7, the structure will appear as illustrated in FIG. 5.

Subsequent to the step of electrodepositing the comb, the UV-exposed portions of the resist parts are removed to form by resist development spaces between portions of the loops 7 and to uncover portions of the lower layers. It should be noted that in the area 18 where the exposed resist occurred, there is only the metal layers 4, 5 and possibly 6. After removing the exposed portions of the resist, the exposed metal layers over the region 18 are then sequentially removed to form an etching mask by sequentially etching the layers through the spaces or gaps between the drive elements 7 and then under the drive elements 7 in the regions 18. After removing the layers 4, 5 and 6 (if present) in the area 18 to form the etching mask, the next step is to etch the ink channels K out of the glass substrate by utilizing the etching mask and an etchant passed through the gaps 13 and with an ultrasonic etching process.

After etching the channels K, the next step comprises removing the remaining portions of the photoresist such as the photoresist portions in the gaps between the mid-portions 14 and the photoresist portions in the nozzle openings D, then loosening the middle part or portion 14 of each of the drive elements 7 from the ridge R by selectively etching the intermediate layer 3. After selectively etching the layer 3 to loosen each of the middle portions 14, the remaining portions of the layers 2 and 4 are then subsequently removed by etching in the vicinity of the ridge R.

Figure 4:
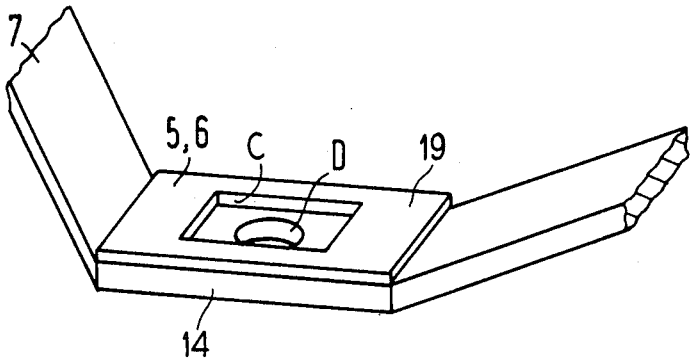
FIG. 4 is a perspective view with portions broken away of a back or bottom side of one of the loop conductor drive elements.

As mentioned in the Ser. No. 815,922, each of the elements 7 in the middle portion 14 may have a cavity C in a surface 19 (FIG. 4) which faces the surface of the ridge or web R of the glass carrier 10. In order to produce a cavity C, the above-mentioned process is modified in the following manner. After depositing the fourth layer 5, a rectangular or oval photoresist structure is provided in the region which will later lie beneath a nozzle hole D. This resist structure will have a thickness of 10 μm. Then, the fifth layer 6 is electrodeposited onto the layer 5 around the photoresist to the same thickness of approximately 10 μm. Subsequently, an additional layer (not illustrated) is deposited over the layer 6 and the photoresist forming the cavity C either by a vapor-deposition process or by sputtering and this additional layer can be a copper layer and have a thickness of 0.5 μm. Subsequent to applying this additional layer, the positive dry resist structure of the electroplating mask is applied and is exposed in those regions 18 and the comb and the elements 7 are then electrodeposited in spaces not covered by the electroplating mask resist structure to form the comb and conductor loops. Subsequently, the exposed portions of the resist structure are removed, the underlying metal layers are etched away as before both between the gaps of the elements 7 and underneath the elements 7, in the regions 18 overlying the position of the channels K to form the etching mask. Then the glass carrier is etched to produce the channel K as before. Then after forming the glass channel K as before, the remaining photoresist F in the gaps 13 as well as the resist F' in the nozzles D is removed and the sixth layer applied on the layer 6 is then etched through the nozzle D and the layer in gaps are etched. It should be noted that the resist utilized to form the cavity C is not exposed because of this sixth layer. After etching the sixth layer as well as those portions of the third, fourth and fifth layers in the gaps, the photoresist under the nozzle or hole D is removed and the part of the layer 5 lying below the cavity is etched through the nozzle hole. Subsequently, the intermediate layer 3 is etched to loosen each of the elements from the ridge R and then the layers 2 and 4 are removed by etching them in the area of the ridge R.

The resist structure F as illustrated in FIG. 5 is adapted in the following fashion to meet the demands for smooth-walled, funnel-shaped nozzle holes D in each conductor loop 7 as well as gaps 13 having a width of less than 30 μm given a loop height of 50 μm. The developed structure is then heated so that it will easily flow and become broader with the side walls 21 sloping as illustrated and becoming smooth. The resist structure such as F' of FIG. 5 which forms the nozzle hole D thus gets bell-shaped. The electrodeposited layer 7 will also grow laterally over the resist structure as illustrated.

Due to the removal of the third, fourth and fifth layers under the working elements 7 in those areas overlying the regions 18, the glass can be eroded from the top to the bottom at any location so that the ink channels K have a flat floor or surface. Only ultrasonic enables the necessary etching exchange through the narrow clearances of the gaps 13 and the uniform glass erosion with the elimination of the etching products.

It should be noted that the layers 2 and 4 are preferably titanium while the layer 3 is aluminum and the layer 5 is copper. Also as noted hereinbefore, the layers 2 and 4 have a thickness of approximately 0.1 μm while the layer 3 has a thickness of 1 μm and the layer 5 has a thickness of about 0.5 μm. Thus, with the layers 2 and 4 being titanium and being the first layer on the glass depending on which surface area, the slope of the glass side walls of the channels K can be varied in a broad range in the glass etching process by selection of either the thickness of the titanium layer or the concentration of the etching material for the glass, which etching material contains hydrofluoric acid or both. Decreasing the titanium thickness and/or increasing the concentration of the hydrofluoric acid in the glass etching material makes the glass side walls steeper. This principle applies regardless of the composition of the glass and of the employment of the ultrasonic during the glass etching step.

When a unipolar current pulse is to be employed for moving each of the working elements 7, then the material for them must be ferromagnetic. In this case, nickel, which can be easily electrodeposited, is particularly suitable. Copper is suitable as a non-ferromagnetic material for the manufacturing methods set forth hereinabove.

With regard to the structure of each of the working elements or conductor loops, they can have the illustrated V-shaped configuration as also illustrated in the above-mentioned copending application. The loops can also be a straight-lined element extending at an angle to the ridge with either a single or multi-row nozzle arrangement as disclosed in U.S. Ser. No. 815,922.

Although various minor modifications may be suggested by those versed in the art, it should be understood that I wish to embody within the scope of the patent granted hereon, all such modifications as reasonably and properly come within the scope of my contribution to the art.

I claim:

1. A method for producing a printing head having a glass substrate with a common ink chamber with two channels separated by a ridge extending along the length of the chamber and having conductor loops extending across the chamber, which loops have a middle portion provided with an ink orifice overlying the ridge, said method comprising the steps of providing a glass substrate with a substrate surface; forming a strip of a double layer on a part of the glass surface corresponding to an area in which the ridge is to be formed by depositing a first metal layer on a surface of the substrate, depositing a second metal layer on the first metal layer to form the first double layer and shaping the first double layer into the strip by removing the double layer except in the area of the ridge; then depositing a second double layer on the strip and substrate surface by depositing a third layer of metal on the strip and the exposed portions of the substrate surface, and depositing a fourth metal layer on the third layer with the steps of depositing the first, second, third and fourth layers being selected from a group consisting of vapor-depositing and sputtering; providing an electroplating mask on an exposed metal surface of the last-applied layer by photolithographically forming a positive dry-resist structure on the metal surface of the last-applied layer, said mask defining a position for each nozzle and leaving portions of the metal surface exposed in a pattern corresponding to the comb having the conductor loops; exposing to UV light portions of the resist structure which overlie a region for each of the two ink channels which are to be subsequently formed; electrodepositing a comb having leads and conductor loops separated by gaps on the portions exposed by the electroplating mask; removing the UV-exposed portions of the resist structure to form spaces between adjacent conductor loops in each of the regions; forming an etching mask for etching the channels by etching the exposed metal layer beneath the spaces and beneath the adjacent conductor loops to expose portions of the substrate surface; removing material from the substrate surface of the glass substrate by utilizing the etching mask and an etching process with ultrasonic to form two ink channels separated by said ridge; subsequently removing the remaining resist structure; and then loosening the middle portion of each of the conductor loops from the glass ridge extending between the ink channels by selectively etching away the second layer and then etching away the first and third layers positioned between the ridge and the middle portions of each of the conductor loops so that each middle portion may move relative to the ridge thus ejecting an ink droplet through its nozzle.

2. A method according to claim 1, which further includes subsequent to applying the fourth metal layer and prior to providing the electroplating mask, electrodepositing a fifth layer onto the fourth metal layer.

3. A method according to claim 2, wherein the step of forming the etching mask includes etching the fifth layer under each of the conductor loops in the region of each channel to be formed.

4. A method according to claim 1, wherein the applying of the photoresist structure includes heating the resist structure to cause a flowing of the material of the resist to produce flattened smooth sloping surfaces and to form at least bell-shaped nozzles.

5. A method according to claim 4, wherein the step of forming the etching mask includes etching to remove the fifth layer under each of the conductor loops in the regions of each of said channels to be formed.

6. A method according to claim 1, wherein each of the nozzles has a cavity on a surface of the middle portion which faces the ridge and said method comprises subsequently to depositing the fourth layer, applying a photoresist structure of a given thickness having the shape of each of said cavities for each of said nozzles, then electrodepositing a fifth metal layer around the photoresist to the thickness of said photoresist structure, then depositing a sixth layer over the fifth layer; and subsequent to the step of removing the remaining resist structure, etching the sixth layer through the nozzle to expose the photoresist and, etching the sixth, fifth, fourth and third layers sequentially in the area extending between the conductor loops, then removing photoresist structures at each of the nozzles, etching the exposed portions of the fourth layer through the nozzle, and then subsequently performing the steps to loosen the conductor loops from the ridge.

7. A method according to claim 6, wherein the step of forming the etching mask includes etching away the fifth and sixth layers beneath each of the conductor loops in the regions of the channels to be formed.

8. A method according to claim 6, wherein the step of applying the photoresist for the cavity and the step of applying the resist structure includes heating to cause a flowing of the structure to obtain sloping side walls and bell-shaped portions of the plating mask for each of the nozzles.

9. A method according to claim 8, wherein the step of forming the etching mask includes removing the fifth and sixth layers beneath each of the conductor loops in the regions of the channels to be formed.

10. A method according to claim 1, wherein the third layer is a layer of titanium metal and the step of removing material to form the channel includes varying the slope of the glass side walls of the channels by selectively varying the thickness of the titanium layer, or the concentration of the glass etchant containing hydrofluoric acid and both the thickness of the third layer and the concentration of the glass etchant.

11. A method according to claim 1, wherein the step of applying the electroplating structure includes heating the resist structure to cause flow of the material to produce sloping side walls and a bell-shaped resist structure defining each of said nozzles.

12. A method for manufacturing a printing part having a glass carrier which on one surface has a common ink chamber with two channels separated by a ridge extending along the length of the chamber and has conductor loops extending across the chamber, which loops have a middle portion provided with an ink nozzle with a cavity overlying the ridge, said method comprising the steps of providing a glass substrate; forming a strip of a first double layer on a surface of the glass substrate overlying an area in which the ridge is to be formed by depositing a first metal layer on a surface of the substrate, depositing a second metal layer on the first metal layer to form the first double layer, shaping the first double layer into the strip by removing the double layer except in the area of the ridge; then depositing a second double layer on the strip and the one surface by depositing a third layer of metal on the strip and the exposed portions of the one surface, and depositing a fourth metal layer on the third layer with the steps of depositing the first, second, third and fourth layers being selected from a group consisting of vapor-depositing and sputtering; creating a photoresist of a given thickness on the fourth layer at the position for each of the nozzles having a cavity; electrodepositing a metal layer around said photoresist to the thickness of said photoresist; depositing a sixth layer over the fifth layer and the photoresist; then providing an electroplating mask structure on the sixth layer by photolithographically forming a positive dry resist structure on the surface of the sixth layer, said mask structure defining a position for each of the nozzles overlying the photoresist and leaving portions of the outermost metal surface exposed in a pattern corresponding to the comb having the conductor loops; UV-exposing portions of the resist structure which overlie a region for each of the two ink channels which are to be subsequently formed; electrodepositing a comb having leads and the conductor loops separated by gaps of the resist portions exposed by the electroplating mask structure; removing the exposed portions of the resist structure to form spaces between adjacent conductor loops in each region; forming an etching mask for etching the channels by etching the exposed metal layers beneath the spaces and beneath the adjacent conductor loops to expose portions of the glass substrate; removing material from the surface of the glass substrate by utilizing the etching mask and an etching process with ultrasonic to form two ink channels separated by said ridge; subsequently removing the remaining resist structure; then removing exposed portions of the sixth layer through each nozzle and then exposed portions of the fifth and fourth layers extending beneath the gaps, removing the photoresist under each nozzle so that the cavity formed in the fifth layer is in communication with the nozzle, removing the exposed portions of the fourth layer by etching through the nozzles, then loosening the middle portion of each of the conductor loops from the glass ridge extending between the ink channels by selectively etching away the second layer and then etching away the first and third metal layers positioned between the ridge and middle portions of each of the conductor loops so that each middle portion may move relative to the ridge in order to eject an ink droplet through its nozzle.

13. A method according to claim 12, wherein the step of providing the electroplating mask includes heating the mask to cause a flow of the material of the resist to produce sloping side walls and a bell-shaped portion of the mask defining each of the nozzles.

* * * * *